United States Patent [19]

Sharp

[11] 4,235,173

[45] Nov. 25, 1980

[54] FURNACE COOLING APPARATUS

[76] Inventor: Kenneth C. Sharp, 30 Mountcombe Close, Upper Brighton Hill, Surbiton, Surrey, Great Britain

[21] Appl. No.: 29,777

[22] Filed: Apr. 13, 1979

[30] Foreign Application Priority Data

Jul. 11, 1978 [GB] United Kingdom ..... 43453/78

[51] Int. Cl.[3] ..... F23M 5/08; C21B 7/10

[52] U.S. Cl. ..... 110/336; 266/194; 432/238

[58] Field of Search ..... 110/180, 336; 122/6 R, 122/6 A, 6 B; 432/253, 238, 237; 266/193, 194; 13/32

[56] References Cited

U.S. PATENT DOCUMENTS

| | | | |
|---|---|---|---|
| 628,790 | 7/1899 | Gaines, et al. | 110/336 X |
| 1,288,925 | 12/1918 | Knox | 432/238 X |
| 2,686,666 | 8/1954 | Tau | 122/6 A X |
| 4,169,387 | 10/1979 | Krempl | 73/708 |

FOREIGN PATENT DOCUMENTS

| | | | |
|---|---|---|---|
| 1444507 | 8/1976 | United Kingdom | 432/238 |
| 499300 | 4/1976 | U.S.S.R. | 266/193 |

*Primary Examiner*—Charles A. Ruehl

[57] ABSTRACT

Furnace cooling apparatus is provided including iron staves on the inside of a steel shell, outer portions of the staves being hollow to define reservoirs filled with water. Heat pipes are mounted in bores in inner solid portions of each stave and extend from inner ends in the reservoir to outer ends spaced a short distance from the inner surface of the stave. The inner surface of a stave has alternating surfaces and recesses and heat pipes aligned therewith have corresponding long and short lengths.

7 Claims, 4 Drawing Figures

FURNACE COOLING APPARATUS

This invention relates to the cooling of furnaces and particularly to cooling apparatus disposed in the walls of the furnace to conduct heat from the working surfaces of these walls. The cooling apparatus of the invention is highly efficient, reliable and trouble-free in operation and is inexpensive to manufacture and readily installed.

BACKGROUND OF THE INVENTION

One of the major inconveniences and sources of expense in the operation of shaft furnaces has been the need to replace the refractory lining of the furnace at intervals. By cooling the refractory lining it can be made to last longer, but the replacement of the cooling means increases the complexity and expense of the relining operation. A method of cooling shaft furnaces known as stave cooling has been known for over fifty years and has generally found favor. This method involves the provision of cast-iron staves or blocks fixed to the furnace shell and in contact with the refractory lining of the furnace. The staves support water-carrying pipes running through them parallel, either vertically or horizontally, to the walls of the furnace and these pipes are disposed at varying distances from the hottest surface of the stave. The disposition of the pipes is such that as one pipe fails as a result of the wear on the stave other pipes situated further from the hottest surface are still operating and take over as the cooling element at the hottest part of the stave.

The cooling system outlined above presents several difficulties, the main ones of which are as follows. It is difficult to cast the pipes in the stave because the pipes tend to become carbonised and hence brittle and may then crack under stress. If, as is usual, the pipes are insulated to avoid becoming carbonised heat transfer between the stave and the water in the pipes is reduced. Each pipe is required to have its own inlet and outlet, and with the commonly used system of four pipes in each stave considerable piping costs are incurred. Once the furthest pipe has been rendered inoperative by the wearing away of the stave the only way in which the furnace can be cooled is to turn the water supply off where it is applied to the pipe inlets and allow the water to flow down the furnace shell. This type of external cooling is not very effective.

SUMMARY OF THE INVENTION

It is an object of the present invention to provide a stave-type cooling system for a shaft furnace in which the difficulties described above are reduced. The invention is based in part upon the concept that heat pipes may be used in a stave-type cooling system.

A heat pipe is a relatively simple structure that transmits thermal energy very efficiently and which has been used in a number of application in other fields. It is a sealed enclosure containing a fluid material and a wick. One end of the pipe is situated adjacent a heat source and the other end adjacent a heat sink. The fluid is chosen so as to be liquid at the sink temperature and in the vapor phase at the heat source temperature. The vapor diffuses from the hot end to the heat sink, where it condenses and the resultant liquid is transported back to the hot end by the capillary action of the wick. Heat pipes are most often cylindrical in shape, but can be made in other forms, for example, a laminary shape.

According to the present invention there is provided a furnace having a stave cooling system including a block of material having a first surface in thermal contact with the refractory lining of the furnaces and a second surface adjacent a reservoir of cooling liquid, the block of material having at least one bore extending inwardly from its second surface and a heat pipe located therein. The heat pipe operates with a high degree of efficiency to rapidly transmit heat, greatly reducing the rate of deterioration of the staves and also protecting itself against damage.

The block of material preferably includes a plurality of bores extending inwardly from its second surface, each bore receiving a corresponding heat pipe.

These bores preferably terminate at varying distances from the first surface of the block. The block may be fabricated from cast iron or refractory or a combination of both.

The reservoir may be located within the cavity formed by the shell of the furnace, or alternatively may be located in an outwardly projecting recess in the shell.

The reservoir preferably has inlet and outlet means by means of which a flow of cooling liquid can be circulated through the reservoir.

Each heat pipe operates as a self-contained unit and failure of one pipe will not affect the remaining pipes. Also, since the fluid in the heat pipe is not in communication with the cooling liquid, the rupture of any heat pipe will not affect the flow of cooling liquid and will not require a shut-down of the furnace.

This invention contemplates other objects, features and advantages which will become more apparent from the following detailed description taken in conjunction with the accompanying drawings.

DESCRIPTION OF THE PREFERRED EMBODIMENT

Figure 1:
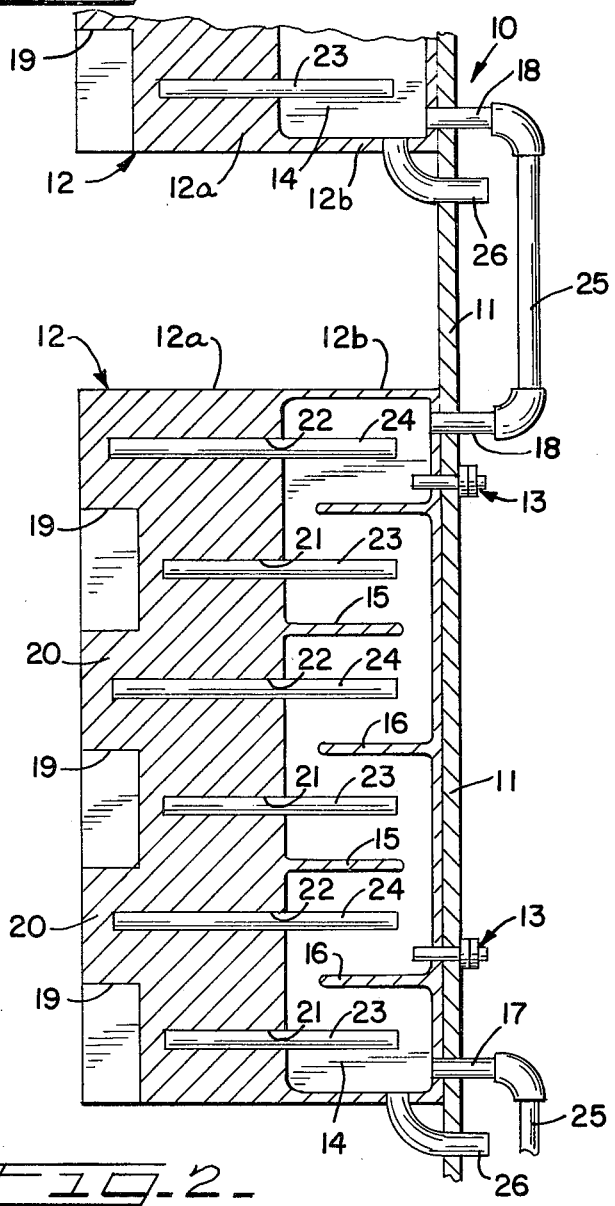
FIG. 1 is a cross-sectional view in a vertical plane through a wall portion of a shaft furnace illustrating in cross-section one form of stave cooling apparatus in accordance with the present invention.

Referring to FIG. 1, reference numeral 10 generally designates a portion of a wall of a shaft furnace incorporating cooling apparatus constructed in accordance with the principles of the invention. The illustrated wall portion 10 includes a steel shell 11 the interior of which is lined in conventional fashion by a thick layer of refractory material, not shown. A number of staves in the form of cast iron blocks 12 are secured on the inside surface of the shell 11 in the region of the bosh and stack of the furnace, suitable securing means such as bolts 13 being provided for this purpose.

Each stave 12 includes a solid portion **12*a* which supports cooling pipes as will be described and a hollow portion 12*b* which defines a reservoir 14 for cooling fluid. The hollow portion 12*b* may preferably be constructed from plates welded to each other and to the solid portion 12*a* and baffle plates 15 and 16 are provided projecting from inner and outer reservoir wall surfaces in a direction generally perpendicular to the direction of fluid flow in the reservoir 14** to provide an increased flow path and to increase the transmission of heat to the cooling fluid.

Fluid is admitted to the reservoir 14 through an inlet pipe 17, circulates through the reservoir and exits through an outlet pipe 18.

The surface of the stave 12 which faces toward the interior of the furnace has a waffled pattern with recessed portions 19 which may preferably be rectangular and with surface portions 20 between adjacent recesses in an inwardly projecting relation to the plane of the inner surfaces of the recesses 19, the width of the projecting portion 20 being about equal to that of the recessed portion 19. A series of transverse bores 21 are provided in the solid portion 12*a* of the stave 12, extending from the reservoir 14 to points spaced a short distance from the surfaces of the recessed portion 19 and another series of bores 22 extend from the reservoir to points spaced about the same short distance from the surfaces of projecting portions 20.

The bores 21 and 22 receive heat pipes 23 and 24 which have outer ends projecting into the reservoir 14, the heat pipes 24 being longer than the heat pipes 23 because of the longer dimensions of the bores 22 in relation to the bores 21.

It will be understood that a number of staves are provided in the furnace wall and they are preferably located in columns with the outlet pipe 18 of each stave being connected to the inlet pipe 17 of the stave immediately above as through a pipe section 25 as shown in FIG. 1. Each reservoir 14 may be additionally provided with a suitable drain cock 26.

Figure 2:
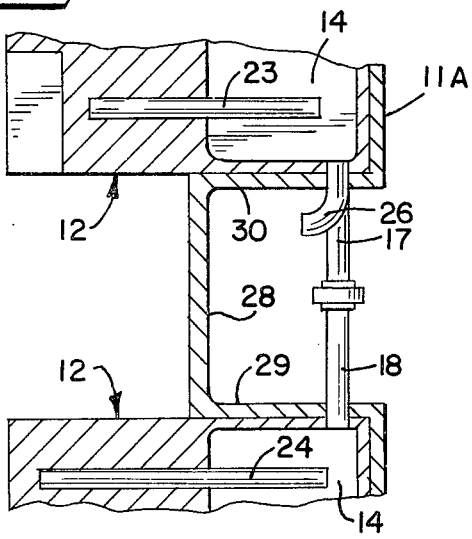
FIG. 2 is a cross-sectional view similar to an upper portion of FIG. 1 but showing an alternative form of stave location in accordance with the present invention.

In the embodiment of FIG. 1, the shell 11 is in the form of a flat, or planar plate. As shown in FIG. 2, an alternative arrangement may be used with a modified plate 11A which includes an inwardly offset wall portion 28 approximately aligned with the inner surfaces of the reservoirs 14, the wall portion 28 being connected to the main portions of the plate 11A by wall portions 29 and 30 respectively, engaging the upper surface of one stave and the lower surface of the next higher stave. In this arrangement, the outlet pipe 18 may extend through the wall portion 29 and the inlet pipe 17 as well as the drain cock 27 may extend through the wall portion 30. Through the provision of the inwardly offset wall portions 28, recesses are in effect formed for receiving the hollow portions 12*b* of the staves 12 in which the reservoirs 14 are provided and, as result, the reservoirs are in effect positioned outside the main volume enclosed by the furnace shell and are thereby more protected.

Figure 3:
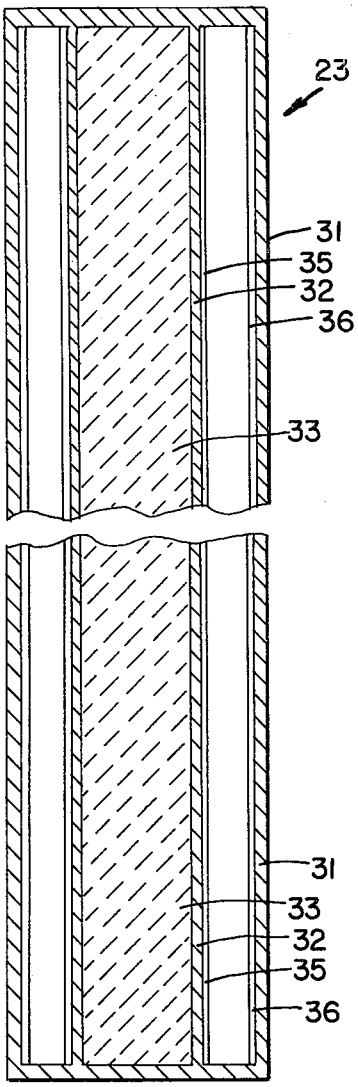
FIG. 3 illustrates in cross-section the construction of a heat pipe for use with the invention.

FIG. 3 is a cross-sectional view of one of the heat pipes 23, it being understood that each of the other heat pipes may have substantially the same construction. The pipe 23 is a sealed cylindrical structure having an outer wall 31 and a concentric inner cylindrical wall 32. The space enclosed by the inner wall 32 is filled with a refractory material 33. The wick 35 is provided around the outer surface of the wall 32 and another wick 36 is similarly provided around the inner surface of the outer wall 31. These two wicks 35 and 36 act independently to transfer liquid from the cooler end of the pipe 23, to the hot end thereof, the cooler end being located in the reservoir 14 and the hot end being located at the end of the bore in which the heat pipe 23 is disposed.

The heat pipe 23 operates in the same general manner as heat pipes which have been used in various applications in other fields and it transmits very efficiently and at a high flow rate, the fluid being vaporized at the hot end to absorb heat and being condensed at the cooler end to transmit heat to the fluid in the reservoir, the fluid in the liquid phase being transmitted back to the hot end through capillary action.

The working fluid used in the heat pipes of the apparatus of this invention is preferably water although other fluids might be used.

Figure 4:
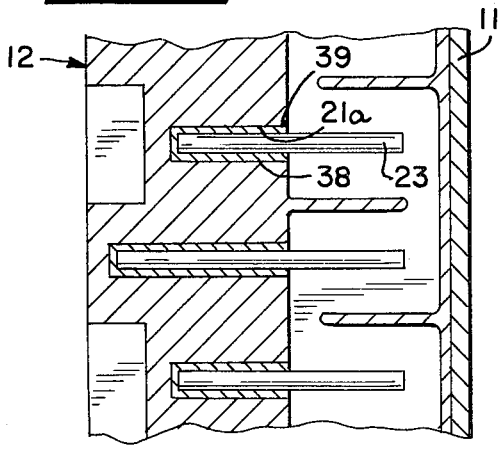
FIG. 4 is a cross-sectional view illustrating a modified heat pipe mounting arrangement.

In the embodiment of FIG. 1, the heat pipes 23 and 24 are so disposed that the outer surfaces of the outer walls thereof directly engage the inside surfaces of the respective bores 21 and 22. FIG. 4 shows a modified arrangement in which an enlarged bore 21*a* is provided in the solid portion of a stave and in which a sleeve 38 of a refractory or ceramic material is inserted in the bore 21*a* to provide a liner, the heat pipe 23 being disposed within the sleeve 38. The sleeve 38 preferably has a closed inner end 38*a* and at its outer end a ring 39 is provided which may be threaded into the end of the bore 21*a*. After insertion, the ring 39 may be welded to the stave.

When the stave cooling arrangement of this invention is in operation, the stave will eventually be worn back by heat and mechanical erosion to the inner ends of the heat pipes. Generally, the longer heat pipes 24 which extend into the projections 20 will be reached first and they may be ruptured while the shorter heat pipes 21 will remain effective to provide in effect a second line of defense. When the shorter heat pipes, or at least a relatively large proportion thereof are destroyed, the drain cocks 26 may be opened and the cooling liquid may be allowed to drain from the reservoirs 14, allowing the cooling liquid to flow down the outside of the shell 11 to provide a last line of defense against overheating before the furnace needs to be relined.

It will be understood that modifications and variations may be effected without departing from the spirit and scope of the novel concepts of this invention.

What is claimed is:

1. In a furnace wall construction, a plurality of staves having inside and outside surfaces, said inside surfaces being arranged for engagement with the outside of a refractory furnace lining, and cooling means including means defining elongated hollow enclosed spaces within said staves and extending outwardly from points close to said inside surfaces of said staves, each of said enclosed spaces containing a fluid for rapid outward transmission of heat from a refractory lining engaged with said inside surfaces of said staves, said cooling means including wick means extending longitudinally within said enclosed spaces for effecting the flow of fluid in a liquid phase to be vaporized at inner end portions of said spaces with the vaporized fluid being condensed at the outer end portions of said spaces.

2. In a furnace wall construction as defined in claim 1, said cooling means further including means defining hollow portions within said staves and arranged to be filled with water for conducting heat away from the outer ends of said elongated hollow enclosed spaces, an outer steel shell engaged with said outside surfaces of said staves, and said outer steel shell including inwardly offset portions between adjacent staves.

3. In a furnace wall construction as defined in claim 2 wherein said hollow portions extend inwardly to a plane in approximate alignment with said inwardly offset portions of said steel shell.

4. In a furnace wall construction as defined in claim 1, said cooling means including pipes having closed end walls and defining said elongated enclosed spaces, said staves having bores receiving said pipes.

5. In a furnace wall construction as defined in claim 4, each of said pipes having a concentric inner cylindrical wall filled with a refractory material.

6. In a furnace wall construction as defined in claim 4, a sleeve of a refractory material surrounding each pipe within each of said bores.

7. In a furnace wall construction as defined in claim 4, the inside surface of each of said staves having a plurality of recesses therein to provide alternating projections and recesses and certain of said bores aligned with said recesses and additional bores aligned with said projections, each bore having an inner end close to the opposed inside surface portion of the stave and each bore having a pipe therein extending to the inner end thereof.

* * * * *